United States Patent [19]

Dowd

[11] 3,963,902

[45] June 15, 1976

[54] METHOD AND APPARATUS FOR PRE-REGISTRATION OF A MULTIPLE CYLINDER ROTARY PRINTING PRESS

[75] Inventor: Daniel J. Dowd, Williamsport, Pa.

[73] Assignee: Westvaco Corporation, New York, N.Y.

[22] Filed: Apr. 29, 1975

[21] Appl. No.: 572,727

[52] U.S. Cl. ..... 235/92 MP; 235/92 PS; 235/92 EA; 235/92 R; 235/103.5 R; 101/181

[51] Int. Cl.[2] ..... G06M 3/00

[58] Field of Search ..... 235/92 MP, 92 EA, 92 PS; 340/268, 271; 235/103.5 R; 101/181

[56] References Cited

UNITED STATES PATENTS

| | | | |
|---|---|---|---|
| 3,178,562 | 4/1965 | Acker et al. | 235/92 MP |
| 3,286,173 | 11/1966 | Argyle | 340/268 X |
| 3,896,377 | 7/1975 | Richardson | 101/181 X |

*Primary Examiner*—Joseph M. Thesz
*Attorney, Agent, or Firm*—W. Allen Marcontell; Richard L. Schmalz

[57] ABSTRACT

Each print cylinder in a multi-color printing press is provided a numerical address for each registration tolerance increment around the print cylinder circumference. An electrically determined reference point common to all print cylinders determines the address origin for each cylinder. Once aligned in operative registration for a particular printing job format, the registered alignment address for each cylinder is recorded. The address record is used to reset the several cylinders of the same machine without need of a web therein when it is desired to print the same job format on a recurrent occasion.

9 Claims, 2 Drawing Figures

METHOD AND APPARATUS FOR PRE-REGISTRATION OF A MULTIPLE CYLINDER ROTARY PRINTING PRESS

BACKGROUND OF THE INVENTION

1. Field of the Invention

The present invention relates to the angular phase registration of a plurality of rotating elements having a common drive line. More specifically, the present invention relates to multi-color rotary printing machines and the method and means therefor for resetting the several print rolls in the machine line to a known position of angular phase registration for a particular, recurrent job format.

2. Description Of The Prior Art

In a multi-color rotary printing press, each print cylinder in the machine line applies a respective image in a different color to a traveling web. It is necessary, therefore, for each print cylinder to run in close, relative phase angle registration with the other cylinders in the line. To avoid an image overlap and consequent confusion and obfuscation of the end resulting composite image, each cylinder, relative to the others, must be aligned to within approximately 0.002 in. of cylinder circumference. This magnitude of tolerance will very more or less depending on the nature of the print job performed.

Normally such printing machines are equipped with automatic control registry systems such as those described by U.S. Pat. Nos. 2,278,933; 3,594,552 and 3,701,464. The basic premise of such automatic registration systems is predicated on the application of a series of control indicia on the print web for sensors respective to each print cylinder to target on. Such sensors control automatic cylinder phase angle shifting mechanisms to align a respective print cylinder with the appropriate control indicia or indicia sequence as the web carries a precisely spaced series of such indicia past the respective print station.

Although the automatic registration control systems will maintain each print cylinder in phase registry with the other cylinder while the machine is running with a web, such automatic control systems are ineffective for initial setup of a print job.

When a machine is originally set up for a particular print format, the various print cylinder must manually be given a phase angle setting that is correct within a limited range relative to the perceptive span of the indicia sensors. Consequently, considerable time and web material is wastefully invested in simply providing the machine with a initial alignment for a particular job.

If a given machine is used to perform a multiplicity of job formats on a recurrent basis, the setup investment must be applied to each recurrence. Under such machine use circumstance, therefore, it would be desirable to record the registration relationship between the several print cylinders of a particular machine for a particular job format so that the cylinders may be returned precisely to the proper registration alignment pursuant to the record when need for a run of that particular job format recurs. It would be additionally valuable to the printer to reset the machine registry for the particular job without the presence of web in the machine to be wasted.

SUMMARY OF THE INVENTION

These and other objects to be subsequently made apparent are the subject of the present invention wherein an electric pulse generator is used to emit a pacing pulse for each linear increment of registration tolerance around a print cylinder circumference.

Each of the print cylinders are provided with single pulse generation means to emit a pulse upon alignment with a fixed angle of reference. The fixed angle of reference of one cylinder in the line is selected as the machine reference. The phase angle of all other cylinders is set relative to the machine reference. Such setting is accomplished by transmitting all pacing pulses to a pulse accumulator or counter which includes a visual display of the total number of pacing pulses received by the counter between starting and stopping events. The single pulse emitted by each revolution of the reference cylinder provides the starting event and resets the counter to discharge the accumulation of previous pulses. The single pulse emission from the remaining print cylinders is used as the stopping event. Consequently, a digital indication is provided for the number of registration tolerance units that an individual print cylinder is arcuately displaced from the respective reference angle. This digital indication therefore becomes a record base for the respective cylinder and job format.

The aforedescribed procedure is repeated for each cylinder in the printing machine for a complete record of the job.

When the same print job recurs, it is only necessary for the printer to return the respective cylinders to the location indicated by the counter which corresponds to the record. The presence or absence of a web in the machine is irrelevant.

BRIEF DESCRIPTION OF THE DRAWING

Relative to the drawing wherein like reference characters designate like or similar elements throughout the several figures of the drawing.

DESCRIPTION OF THE PREFERRED EMBODIMENT

Figure 1:
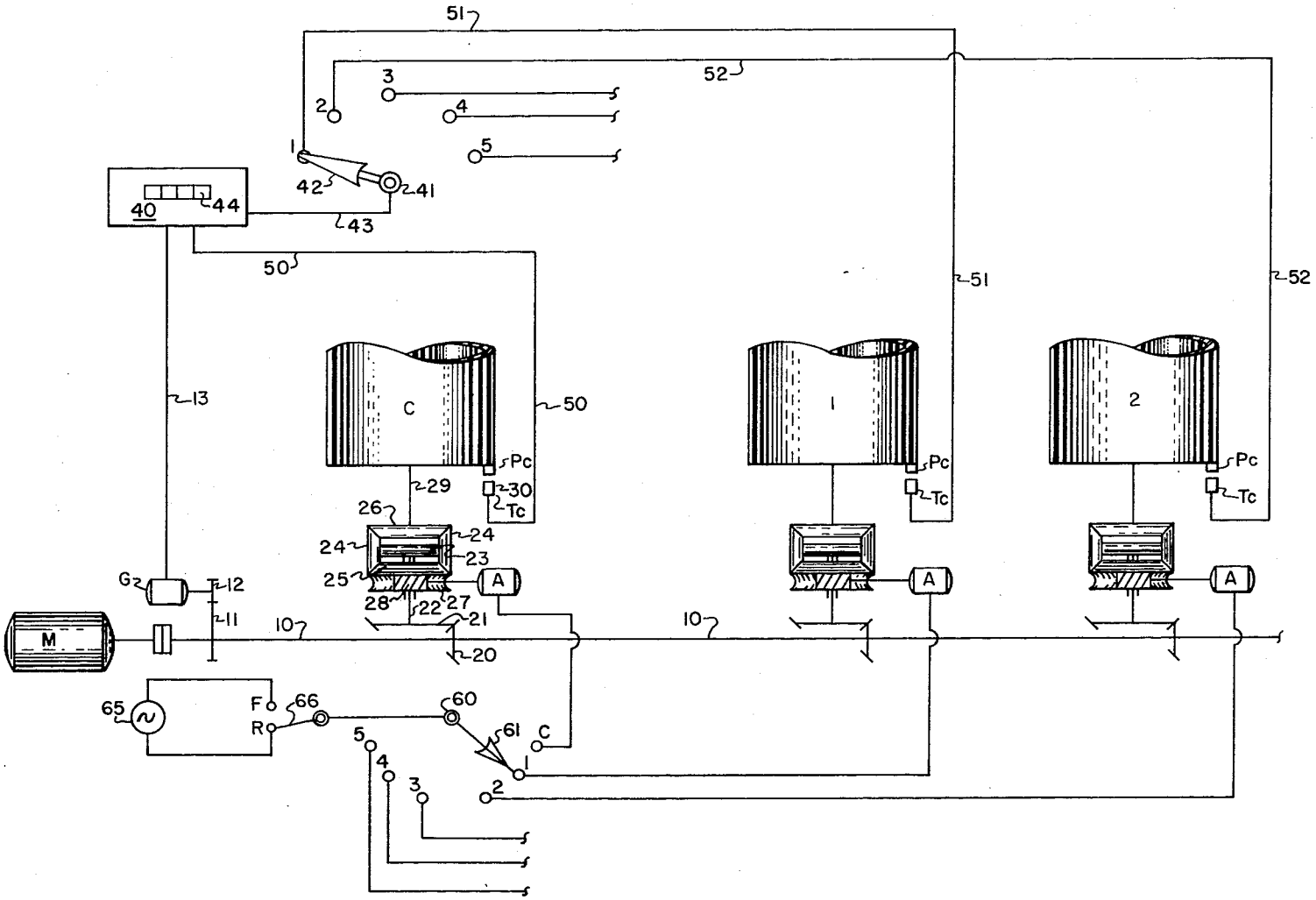
FIG. 1 is a schematic representation of a multi-print cylinder rotary printing machine including the cylinder power drive line and the present invention.

Relative to FIG. 1, print cylinders c, 1, 2, etc. of a multi-color rotary printing press are represented. Each cylinder is set up to apply a different color to the web subject, there being no absolute limit as to the number of print cylinders in a line.

All print cylinders are driven by a common line-shaft 10 driven by motor M. Rotative power for each print cylinder is drawn through a convenient mechanism which allows angular adjustment of the respective cylinder relative to an angular reference position of the line shaft 10. Although the differential mechanism illustrated by FIG. 1 is a conventional and well known in the art, U.S. Pat. Nos. 2,863,387; 3,679,316; 3,717,092; and 3,841,216 disclose suitable alternative mechanisms.

The differential mechanism illustrated comprises a beveled spider drive gear 21 meshed with a beveled driver 20 that is rotatively secured to the line shaft 10. The spider drive shaft 22 is secured to the spider yoke 23. At the opposite outer ends of the yoke 23, two spider gears 24 are journaled for rotation. The spider gears mesh with two pinion gears 25 and 26, respectively. Pinion gear 25 is integral with a worm hob 27 and remains relatively stationary in operation. Pinion gear 26 is secured to the cylinder drive shaft 29 and journaled for operational axial rotation.

Worm hob 27 is meshed with a worm gear 28 which may be rotatively driven in either direction by a reversible motor A. However, worm gear 28 is journaled to statically withstand axial thrust in either direction.

Also driven by the line shaft 10 is an electric pacing pulse generator G. The power transmission between the line shaft 10 and the generator G may be any arrangement which maintains a close tolerance angular relationship between the line shaft and generator shaft such as the two meshed spur gears 11 and 12 illustrated.

Pacing pulse generator G is a conventional, square wave electric pulse emitter such as a model GP8-250 Gyrapulser manufactured by the Copar Corporation of Oak Lawn, Illinois, which emits 500 pulses for each revolution of the generator drive shaft. By mating the spur gears 11 and 12 with a 2:1 ratio speed increase, for example, 1000 pulses per line shaft 10 revolution may be developed.

In addition to providing angular adjustment between the line shaft 10 and the print cylinders, the differential mechanism provides an angular speed reduction between the line shaft and the cylinders. For example, the bevel gears 20 and 21 may be mated with a 5:1 ratio and the spider-pinion differential mated with a 2:1 ratio. Collectively, therefor a 10:1 angular speed reduction between the line-shaft 10 and the print cylinders is provided.

Pursuant to the illustrative ratios, will produce 1000 pulses from generator G and 1/10 (36°) of a revolution of each print cylinder. Consequently, 10,000 pacing pulses are generated for each print cylinder revolution. Relating these 10,000 pacing pulses to a 25 inch circumference print cylinder, for example, one pacing pulse is generated for each 0.002 inch of cylinder circumference: an acceptable span of registration tolerance between sequential print stations.

Continuing with a description of the physical components of the present invention, each print cylinder is provided with a single, electric pulse emitter 30 comprising trigger pin P secured to one end of each print cylinder near the outer periphery thereof. Each single pulse emitter 30 also includes a magnetic proximity sensor T which emits a single electric pulse in response to the proximate passage of the trigger pin P. The sensor T is secured in a fixed position relative to all rotating elements of the machine: for example, to a rigid framing member. In conjunction with the trigger pin Pc, sensor Tc provides an arbitrarily located, fixed reference angle for the selected registration reference cylinder c. The same is true for trigger pins $P_1$, $P_2$, etc. and sensors $T_1$, $T_2$, etc. respective to the dependent print cylinders 1, 2, etc. There is no need for any type of alignment between the reference angle of cylinder c and those of dependent cylinders 1, 2, etc.

The signal management system of the present invention comprises a digital counter 40 such as a model PCRS-1 manufactured by Copar Corporation of Oak Lawn, Illinois, which will accept individual signals respective to counting pulses, starting pulses and stopping pulses through a front panel mounted selector switch.

The continuous spacing pulse signal stream 13 from generator G provides the counting pace for counter 40. Signal 50 from the single pulse emitter 30 respective to the selected reference print cylinder *c*, preferably the first in the sequential print line, is directed to the count start terminal of the counter 40. Signals 51, 52, etc. from single pulse emitters 30 respective to subsequent dependent print cylinders 1, 2, etc. are directed to respective terminals of a rotary switch 41. Rotary contact point 42 is positioned to individually connect the switch terminals respective to the several dependent print cylinders 1, 2, etc. to the stop terminal of the counter 40 via conduit 43.

Counter 40 is also provided with a digital display 44 which visually represents the magnitude of pacing pulses received by the counter 40 during a one revolution interim of reference cylinder *c*. Signal 50, therefore, not only starts the pacing pulse accumulation but discharges the counter 40 storage of pacing pulses accumulated from the previous revolution of reference cylinder *c*. Such discharge also includes the erasure of display 44 of the visual representation of the past interim accumulated pacing pulses.

Each differential mechanism is controlled by a respective reversing motor A which turns the cooperative worm gear 28 to advance or retard the stationary reference position of pinion 25. For this purpose a second rotary switch 60 is provided to connect a suitable power source to switch terminals respective to each motor A via a rotary contact 61. A polarity reversing switch 66 is positioned between the power source 65 and the rotary selector switch 60 to determine the rotational drive direction of motors A.

Figure 2:
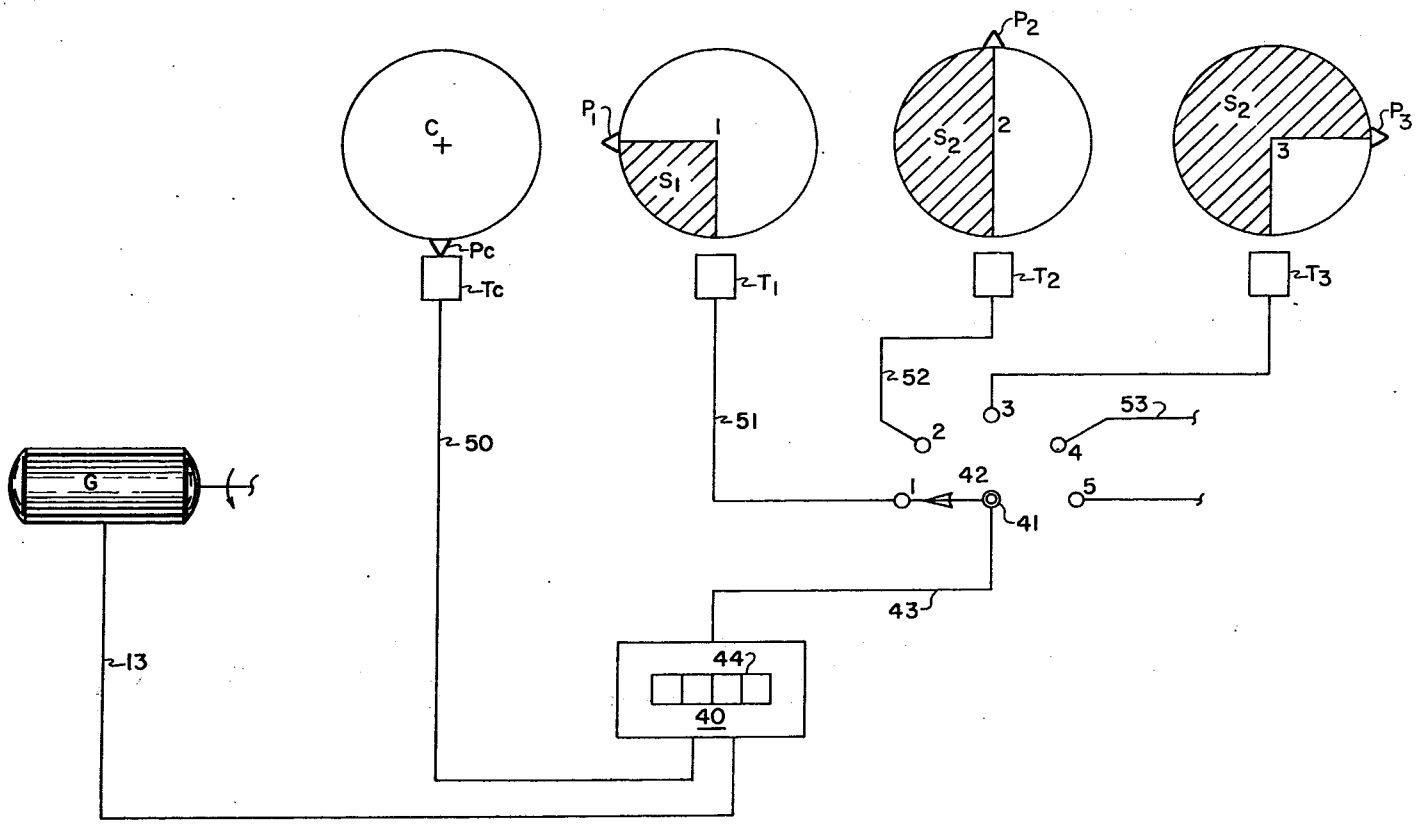
FIG. 2 is a schematic illustration of the present invention operation.

The operation of the aforedescribed apparatus will be further described relative to FIG. 2.

A particular print job is first registered in the printing machine by conventional prior art techniques. Once registered, a record is taken of the angular position of registration for each dependent print cylinder 1, 2, 3, etc. relative to the reference cylinder *c* by means of the present apparatus. This record comprises the digital quantity displayed by the counter 40 for each dependent cylinder 1, 2, 3, etc. while running in desired registration. As the web of the original job is driven through the machine, the pacing pulse generator G emits one pulse 13 for each 0.002 in. of cylinder surface travel. Since all print cylinders are of identical circumferential magnitude, this relationship is true for all cylinders. These pulses are continuously received by counter 40 but are not accumulated by the digital display until started by passage of the reference cylinder *c* single pulse emitter pin Pc through the proximity field of sensor Tc. This event generates a start signal 50 which initiates a digital accumulation of pulses 13 which is shown visually by the display 44.

Simultaneous with the emission of start signal 50, the pulsing pins $P_1$, $P_2$, $P_3$ respective to the dependent cylinders 1, 2, 3, etc. are distributed angularly thereabout in positions uniquely dependent on the particular job jormat. Regardless of the angular position of a particular pin P, however, it is known to have a registered relationship with the reference cylinder *c*. This registered relationship, therefore, becomes the subject of measurement and is represented for each dependent cylinder by the arc of the respective shaded areas $S_1$, $S_2$, $S_3$ of dependent cylinders 1, 2, 3, etc.

If the registration relationship of dependent cylinders 1 is to be recorded, the rotary contact 42 of switch 41 is aligned with the appropriate fixed contact to connect the signal 51 with the stop terminal of counter 40. When the pulse emitter pin Pc of reference cylinder c starts the count accumulation with signal 50 and dependent cylinder 1 pin $P_1$ is at the position illustrated, the count will continue as pin $P_1$ traverses the arc of shaded area $S_1$. Upon alignment with the sensor $T_1$, signal 51 is emitted to stop the count accumulation. The final count accumulation number therefore, represents the registered position of dependent cylinder 1 relative to reference cylinder *c* and is recorded for future use.

The foregoing procedure is repeated for each dependent cylinder in the line until a record of the relative position of registration is completed for all dependent cylinders in the print line.

At some later time, when the original job registration has been disrupted as by intervening performance of a different print job, the registration record may be used to reset machine for a subsequent production run of the original job. In distinction from prior art techniques, however, the machine resetting procedure does not require the presence of a web in the print line to carry a continuous series of registration indicia along the print line for the dependent cylinders to "home" in on.

By the present procedure, it is simply necessary to run the machine "dry," without a web, and systematically realign the phase relationship of the several print cylinders 1, 2, 3, etc. relative to the reference cylinder *c* pursuant to the original run record. This is accomplished, while the machine is running, by advancing or retarding each dependent cylinder using the rotary contact 61 of the rotary switch 60 in alignment with the appropriate stationary contact for a respective different adjusting motor A. The power source 65 polarity reversing switch 66 will determine the direction of angular shift. Consequently, the rotational phase alignment of a dependent cylinder is manipulated until the counter 40 digital display 44 duplicates the record for a particular dependent cylinder. The procedure is repeated until all dependent cylinders are adjusted to phase registration pursuant to the original record.

In this manner, the angular phase registry of all print rolls is precisely reset without web waste. Even if slight differences in web properties relative to those of the original job introduce error to the registration alignment as reset, the differences will be of sufficiently small magnitude as to be quickly accommodated by the automatic registration control and thereby minimize waste.

It should be understood that specific gear ratios, dimensions and other numerical relationships have been described for reasons of explanative clarity and certainty. Obviously, these relationships may be manipulated to achieve more or less refinement in control order than the one pulse per 0.002 in. of cylinder circumference described.

Similarly, other signal generation systems such as photo-electric and laser may be used in lieu of the electro-magnetic components described. There are many such alternative signal generation systems known to the art and the substitution of such alternative systems of components for those specifically described herein is to be considered within the compass of my invention.

Those skilled in the art will also appreciate that the print cylinder phase re-registration system described herein may be further automated by directing a signal proportional to the magnitude of accumulated pacing pulses respective to each print cylinder to differentiating circuit which compares the proportional signal to a set-point signal and derives an error signal therefrom. The set-point signal is a compatible proportionality of the digital magnitude which represents the desired phase angle registry of a dependent cylinder 1, 3, 4, etc. with the reference cylinder *c*. Such an error signal may be evaluated and managed to automatically energize the worm motor A to adjust the differential mechanism until the error signal is eliminated.

By carrying the invention to this degree of automation, the only manual function necessary to pre-setting the machine registration would only be to program a set-point entry console with the desired registration numbers respective to each dependent print cylinder for a particular job format. All comparison and cylinder phase angle manipulation functions would thereafter be conducted automatically, in sequence.

Having fully and completely described my invention, I claim:

1. A method of setting, to a predetermined order, the rotational phase relationship between a plurality of rotating elements having a precise rotational ratio relationship with a common rotary power transmission line, each of said rotating elements having a rotational phase angle adjusting mechanism disposed between said common transmission line and the respective rotating element, said method comprising the steps of:

A. Rotatively driving said rotating elements with said rotary transmission line;

B. Generating a large, finite number of pacing pulse signals respective to each revolution of said rotary power transmission line;

C. Generating a reference pulse signal for each revolution of each rotating element when a respective rotating element passes a predetermined fixed angular position;

D. Selecting the reference pulse signal respective to a first of said rotating elements as a starting signal;

E. Digitally accumulating with counting means the number of said pacing pulses emitted from the instant of said start signal generation.

F. Stopping said pacing pulse accumulating when a reference pulse signal is generated from a respective second rotating element.

G. Comparing the total number of pacing pulses accumulated between said starting and stopping reference pulse signals to a predetermined quantity which relates uniquely to the desired registration alignment of said first and second rotating elements within the full rotative cycle thereof; and, H. Shifting the angular relationship of said second rotating element relative to said first rotating elemet until the digital accumulation of said total number of pacing pulses substantially equals said predetermined quantity.

2. A method of resetting the angular phase registry between a plurality of rotary print cylinders driven by a common rotary transmission line at substantially identical speed ratios therebetween, each of said plurality of rotary print cylinders having a rotational phase angle adjusting mechanism operatively disposed betwen said common transmission line and a respective print cylinder, said method comprising the steps of:

A. Rotatively driving said print cylinders with said rotary transmission line;

B. Generating a large, finite number of pacing pulse signals respective to each revolution of said rotary transmission line;

C. Generating a reference pulse signal for each revolution of each print cylinder when a respective print cylinder passes a predetermined fixed angular position;

D. Selecting the reference pulse signal respective to a first one of said print cylinders as a start signal;

E. Digitally accumulating with counting means the number of said pacing pulses emitted from the instant of a start signal;

F. Stopping said pacing pulse accumulation when a reference pulse is generated as a stop signal from a respective second one of said print cylinders;

G. Recording the total number of pacing pulses accumulated between said start and stop signals respective to said second print cylinder when said second print cylinder is known to be at a desired position of angular phase registration with said first print cylinder that is unique within the full rotative circle thereof;

H. Comparing the total number of pacing pulses accumulated between start and stop signals respective to said second print cylinder when said second print cylinder is known to have departed from said desired position of angular phase registration with said first print cylinder; and I. Shifting the angular phase relationship of said second print cylindner relative to said first print cylinder with said phase angle adjusting mechanism until the accumulated total number of pacing pulses substantially matches the accumulated total number of pacing pulses recorded relative to said second print cylinder.

3. A method as described by claim 2 wherein a single one of said pacing pulse signals is emitted coincident with the rotational passage of a linear increment of print cylinder circumference approximately equal to a desired point registry tolerance.

4. A method as described by claim 2 wherein the accordance of total pacing pulses is taken while said plurality of print cylinders are collectively printing a traveling web in desired registry.

5. The method as described by claim 2 wherein said angular phase shifting of said second print cylinder is performed while said second print cylinder is rotating but without the presence of a traveling web therewith.

6. An apparatus for resetting the angular phase registry between a plurality of rotary print cylinders driven by a common rotary transmission line at substantially identical speed ratios therebetween, each of said plurality of print cylinders having a rotational phase angle adjusting mechanism operatively disposed between said common transmission line and a respective print cylinder, said apparatus comprising:

A. Means for generating a large, finite number of pacing pulse signals respective to each revolution of said rotary transmission line;

B. Means for generating a single reference pulse signal for each full revolution of a print cylinder when a respective print cylinder passes a predetermined fixed angular position of rotation;

C. Means for accumulating said pacing pulse signals including means for digitally displaying the total number of pacing pulses accumulated between starting and stopping events;

D. Means responsive to a first reference pulse signal from a first one of said plurality of print cylinders for effecting a starting event with said pacing pulse accumulating means;

E. Means responsive to second reference pulse signals respective to each of the remaining plurality of print cylinders for effecting a stopping event with said pacing pulse accumulating means;

F. Means for restricting the response of said stopping event means to a select one of said second reference pulse generating means at any given moment of time; and G. Means for operating said phase angle adjusting mechanism respective to each print cylinder while said transmission line and print cylinders are rotating to set each of said remaining print cylinders at respective unique angles within the full rotative circles thereof relative to said first point cylinder pursuant to a predetermined numerical magnitude represented by said digital display means.

7. Apparatus as described by claim 6 wherein said pacing pulse generating means comprises an electrical pulse wave generator coupled with said transmission line by speed ratio means whereby one pacing pulse signal is generated coincident with the rotational passage of a linear increment of print cylinder circumference approximately equal to a desired print registry tolerance.

8. Apparatus as described by claim 6 wherein said reference pulse generating means comprises a single trigger pin secured to each of said print cylinders and a magnetic proximity sensor secured in a fixed position relative to the rotation of said print cylinders and operatively proximate of a circular locus of said trigger pin whereby an electrical pulse is emitted with each revolution of a respective print cylinder which carried said trigger pin past the proximity of said magnetic sensor.

9. Apparatus as described by claim 6 wherein said pacing pulse signal accumulating means further comprises resetting means responsive to said starting event to erase the pacing pulse signal accumulation of the preceding revolution of said first print cylinder.

* * * * *

UNITED STATES PATENT OFFICE

CERTIFICATE OF CORRECTION

PATENT NO. : 3,963,902
DATED : June 15, 1976
INVENTOR(S) : Daniel J. Dowd

It is certified that error appears in the above-identified patent and that said Letters Patent are hereby corrected as shown below:

Column 1, line 48, correct the spelling of --cylinders--; line 53, delete "a" and insert --an--. Column 2, line 61 delete "a". Column 4, line 62, correct the spelling of --format--. Column 6, line 5, following "to" second occurrence insert --a--;

Column 7, line 32 (Claim 2, line 40), correct the spelling of --cylinder-- first occurrence; line 44 (Claim 4, line 2), delete"accordance" and insert --recordation--; line 47 (Claim 5, line 1), delete "The" and insert --A-- therefor.

Signed and Sealed this

Nineteenth Day of October 1976

[SEAL]

*Attest:*

RUTH C. MASON
*Attesting Officer*

C. MARSHALL DANN
*Commissioner of Patents and Trademarks*